US006694291B2

(12) United States Patent
Mauro et al.

(10) Patent No.: US 6,694,291 B2
(45) Date of Patent: Feb. 17, 2004

(54) SYSTEM AND METHOD FOR ENHANCING LOW FREQUENCY SPECTRUM CONTENT OF A DIGITIZED VOICE SIGNAL

(75) Inventors: Anthony P. Mauro, San Diego, CA (US); Gilbert C. Sih, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 421 days.

(21) Appl. No.: 09/745,244

(22) Filed: Dec. 20, 2000

(65) Prior Publication Data

US 2001/0001853 A1 May 24, 2001

Related U.S. Application Data

(63) Continuation of application No. 09/199,072, filed on Nov. 23, 1998, now Pat. No. 6,233,549.

(51) Int. Cl.[7] ..... G10L 19/06
(52) U.S. Cl. ..... 704/205; 704/226
(58) Field of Search ..... 704/205, 207, 704/208, 210, 219, 220, 221, 226, 227; 381/94.3

(56) References Cited

U.S. PATENT DOCUMENTS

| | | | | |
|---|---|---|---|---|
| 4,901,307 A | | 2/1990 | Gilhousen et al. | 320/18 |
| 5,054,085 A | | 10/1991 | Meisel et al. | 381/43 |
| 5,414,796 A | | 5/1995 | Jacobs et al. | 704/221 |
| 5,517,595 A | | 5/1996 | Kleijn | 704/205 |
| 5,684,926 A | * | 11/1997 | Huang et al. | 704/268 |
| 6,006,180 A | | 12/1999 | Bardaud et al. | 704/223 |
| 6,070,137 A | * | 5/2000 | Bloebaum et al. | 704/227 |
| 6,078,880 A | | 6/2000 | Zinser, Jr. et al. | 704/208 |
| 6,081,777 A | | 6/2000 | Grabb | 704/220 |
| 6,233,549 B1 | * | 5/2001 | Mauro et al. | 704/207 |

* cited by examiner

*Primary Examiner*—Susan McFadden
(74) *Attorney, Agent, or Firm*—Philip Wadsworth; Kent Baker; Sandra L. Godsey

(57) ABSTRACT

A system for enhancing low frequency spectral content of a signal transmitted via a channel, that includes a noise suppression circuit to update channel energy estimates; and a spectral enhancer circuit coupled to and follows the noise suppression circuit, the spectral enhancer circuit to determine channel enhancement in response to the channel energy estimates.

6 Claims, 6 Drawing Sheets

SYSTEM AND METHOD FOR ENHANCING LOW FREQUENCY SPECTRUM CONTENT OF A DIGITIZED VOICE SIGNAL

CROSSREFERENCE

This application is a continuation of U.S. application Ser. No. 09/199,072, filed on Nov. 23, 1998, entitled "LOW FREQUENCY SPECTRAL ENHANCEMENT SYSTEM AND METHOD," now U.S. Pat. No. 6,233,549, issued on May 15, 2001.

BACKGROUND OF THE INVENTION

1. Field of Invention

This invention relates to telecommunications systems. Specifically, the present invention relates to a system and method for digitally encoding and decoding speech.

2. Description of the Related Art

Transmission of speech by digital techniques has become widespread for telephony, voice email, and other applications. This, in turn, has created interest in improvements in speech processing techniques. One area in which improvements are needed is that of spectral enhancement, in particular, low frequency spectral enhancement. In systems where much of the low frequency content has been lost, energy may be removed from the fundamental pitch harmonic of the voice signal, causing the voice to sound "tinny." Loss of low frequency content may be due to the acoustic features of the equipment being used, the analog electronics or the transmission path characteristics of the system, or the effects of digital processing of the voice signal.

In equipment such as a phone, the acoustic features are defined by the phone design (plastics, microphone placement), the way a user holds the phone, and the environment that a user is in. The shape of the plastics may create an acoustic null at certain frequencies. The way a user holds the phone affects the acoustic response because the user may, for example, not talk directly into the microphone. The user's environment affects the acoustic frequency response by altering the characteristics of a signal transmitted through the environment. For example, when a hands-free phone is used inside a vehicle, acoustic reflections bouncing around inside the vehicle combine together and may cause the voice to sound tinny.

In a phone, the microphone transforms the acoustic signal into an electrical signal. The electrical signal is processed by analog electronics, which filters the signal so that the low frequencies may be attenuated. If the electrical signal carrying voice information is passed through an analog transmission medium, such as a twisted wire pair or coaxial cable in the telephone network, the frequency content of the voice signal may be further affected.

In the digital domain, the use of noise suppression may cause the voice to sound tinny. Noise suppression generally serves the purpose of improving the overall quality of the desired audio signal by filtering environmental background noise from the desired speech signal. Noise suppression is particularly important in environments having high levels of ambient background noise, such as an aircraft, a moving vehicle, or a noisy factory. Noise suppression may cause the voice to sound tinny because the noise sought to be suppressed is concentrated in the low frequencies.

Hence, a need exists in the art for an improved system and method for enhancing the low frequency spectral content of digitized voiced speech.

SUMMARY OF THE INVENTION

The need in the art is addressed by the system and method for enhancing low frequency spectral content of a digitized voice signal of the present invention. The inventive system and method identifies a fundamental frequency component in a digitized signal and selectively boosts signals within a predetermined range thereof. In the illustrative embodiment, the digitized signal is a frequency domain transformed speech signal. The invention amplifies the low frequency components of the speech signal. The speaker unique fundamental frequency of the speech is computed using pitch delay information and is thus dynamic from frame to frame and also speaker to speaker. This fundamental frequency defines the center point of a gain window which is applied to select frequency components. Only such fundamental frequency components which exhibit a large enough signal to noise ratio have the amplification function applied. Thus, this function can be applied in conjunction with a noise suppression system which has knowledge of the signal quality in each frequency bin. The gain window employs ramp up and hangover to smooth the amplification function between successive frames.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1A:
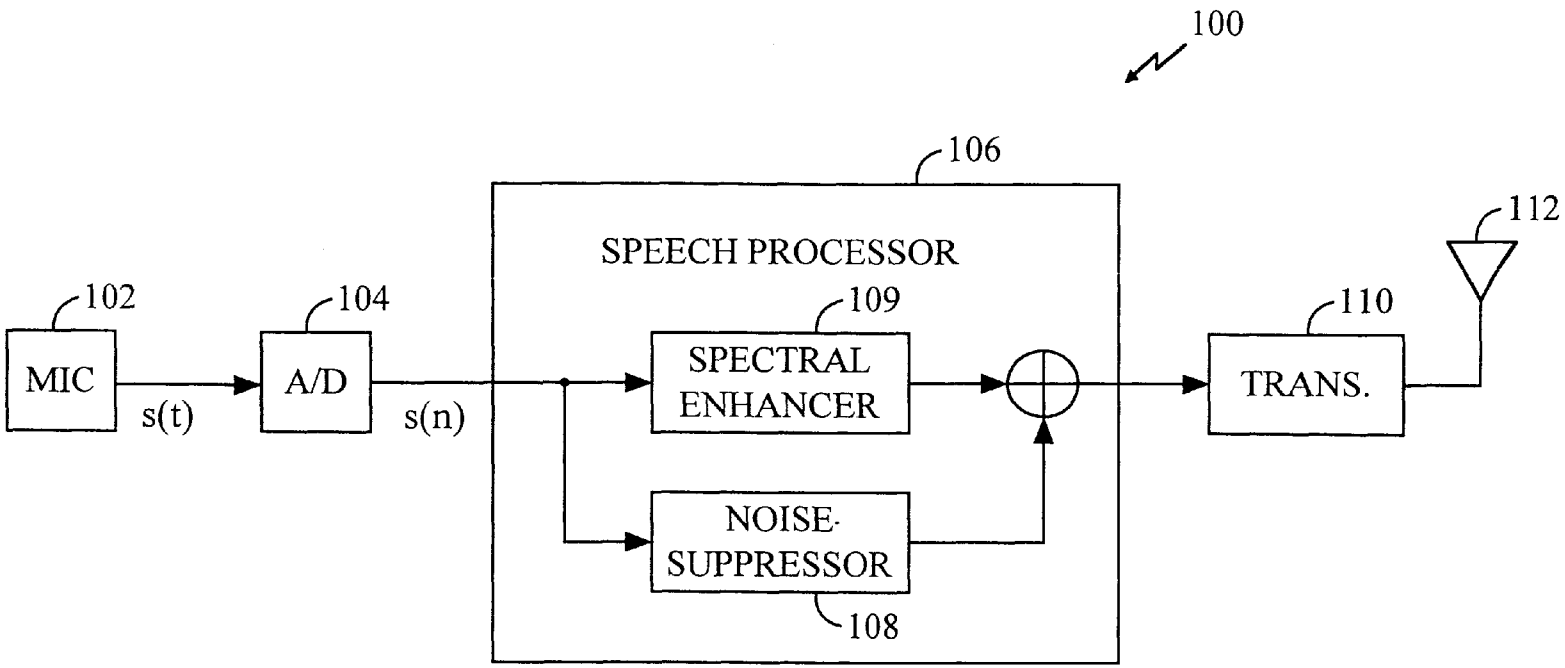
FIG. 1*a* is a block diagram of a first embodiment of a communications system in which the spectral enhancer of the present invention may be utilized.
Figure 1B:
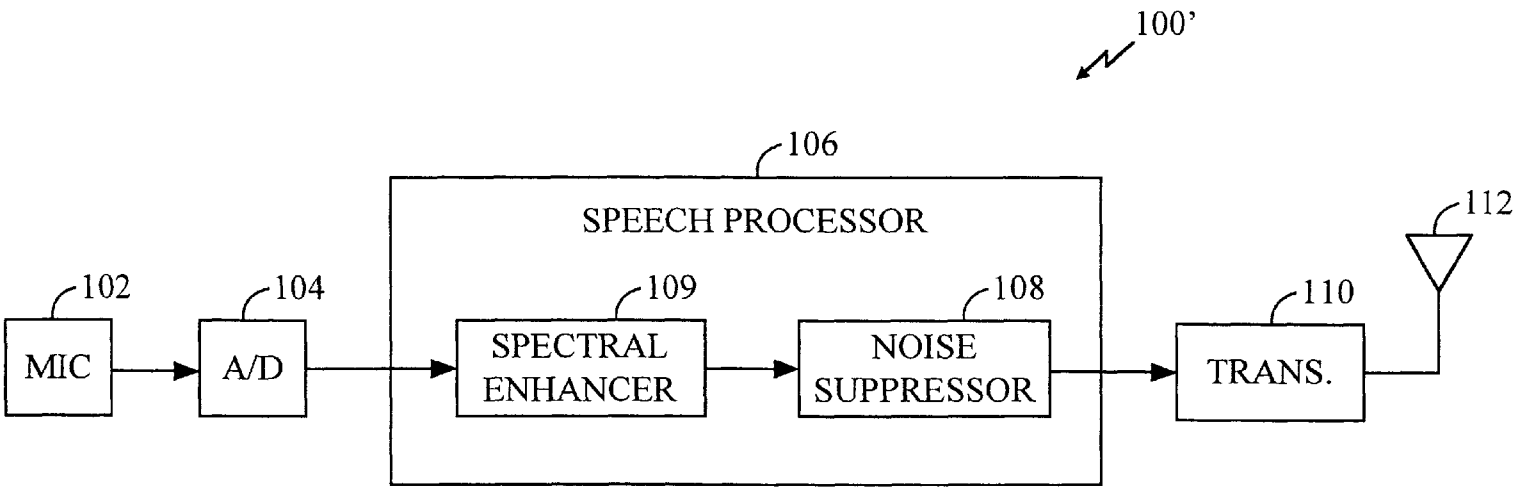
FIG. 1*b* is a block diagram of a second embodiment of a communications system in which the spectral enhancer of the present invention may be utilized.
Figure 1C:
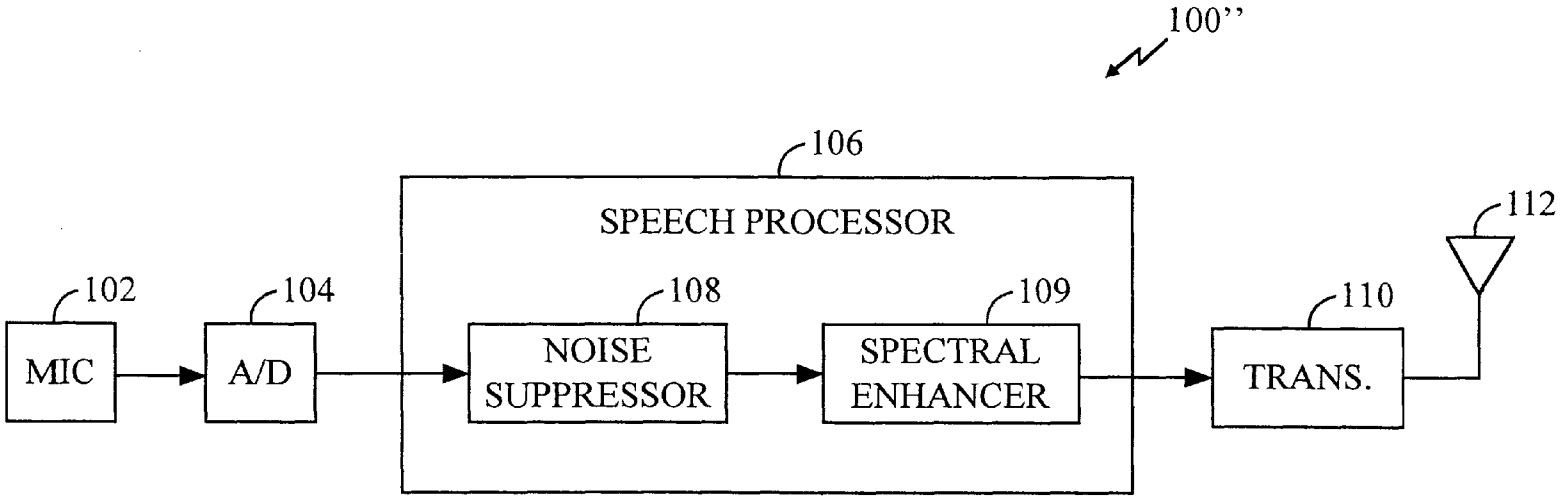
FIG. 1*c* is a block diagram of a third embodiment of a communications system in which the spectral enhancer of the present invention may be utilized.

An exemplary speech processing system 100 in which the present invention may be embodied is illustrated in various embodiments in FIGS. 1*a*–1*c*. The system 100 comprises a microphone 102, an A/D converter 104, a speech processor 106, a transmitter 110, and an antenna 112. The microphone 102 may be located in a cellular telephone together with the other elements illustrated in FIG. 1*a*. Alternatively, the microphone 102 may be the hands-free microphone of the vehicle speakerphone option to a cellular communication system. The vehicle speakerphone assembly is sometimes referred to as a carkit.

Referring still to FIG. 1*a*, an input audio signal, comprising speech and/or background noise, is received by the microphone 102. The input audio signal is transformed by the microphone 102 into an electro-acoustic signal represented by the term s(t). The electro-acoustic signal may be converted from an analog signal to pulse code modulated (PCM) samples by the Analog-to-Digital converter 104. In an exemplary embodiment, PCM samples are output by the A/D converter 104 at 64 kbps as a signal s(n). The digital signal s(n) is received by a speech processor 106, which comprises, among other elements, a noise suppressor 108 and a spectral enhancer 109.

The noise suppressor 108 suppresses noise in signal s(n). The spectral enhancer 109 amplifies the low frequency components of the speech signal in accordance with the present invention.

The noise suppressor 108 and the spectral enhancer 109 may run concurrently as illustrated in FIG. 1*a*, the noise suppressor 108 may follow the spectral enhancer 109 as illustrated in FIG. 1*b*, or the noise suppressor 108 may precede the spectral enhancer 109 as illustrated in FIG. 1*c* without departing from the scope of the present teachings.

As discussed more fully below, the inventive enhancer identifies a selected frequency component in a digitized signal and selectively boosts signals within a predetermined range thereof. In the illustrative embodiment, the digitized signal is a frequency domain transformed speech signal. The speaker unique fundamental frequency of the speech is computed using pitch delay information and is thus dynamic from frame to frame and also speaker to speaker. This defines the center point of a gain window which is applied to select frequency components. Only such fundamental frequency components which exhibit a large enough signal to noise ratio have the amplification function applied. Thus, this function can be applied in a speech processor 106 having a noise suppression system 108 which has knowledge of the signal quality in each frequency bin. The gain window is ramped up and hanged over to smooth the amplification function between successive frames.

In addition to the noise suppressor 108 and the low frequency enhancer 109, a speech processor 106 generally comprises a voice coder, or a vocoder (not shown), which compresses speech by extracting parameters that relate to a model of human speech generation. A speech processor 106 may also comprise an echo canceler (not shown), which eliminates acoustic echo resulting from the feedback between a speaker (not shown) and a microphone 102.

Following processing by the speech processor 106, the signal is provided to a transmitter 110, which performs modulation in accordance with a predetermined format such as Code Division Multiple Access (CDMA), Time Division Multiple Access (TDMA), or Frequency Division Multiple Access (FDMA). In the exemplary embodiment, the transmitter 110 modulates the signal in accordance with a CDMA modulation format as described in U.S. Pat. No. 4,901,307, entitled "SPREAD SPECTRUM MULTIPLE ACCESS COMMUNICATION SYSTEM USING SATELLITE OR TERRESTRIAL REPEATERS," which is assigned to the assignee of the present invention and incorporated by reference herein. The transmitter 110 then upconverts and amplifies the modulated signal, and the modulated signal is transmitted through an antenna 112.

It should be recognized that the spectral enhancer 109 may be embodied in speech processing systems that are not identical to the system 100 of FIG. 1. For example, the spectral enhancer 109 may be utilized within an electronic mail application having a voice mail option. For such an application, the transmitter 110 and the antenna 112 of FIG. 1 will not be necessary. Instead, the spectral enhanced signal will be formatted by the speech processor 106 for transmission through the electronic mail network.

Figure 2:
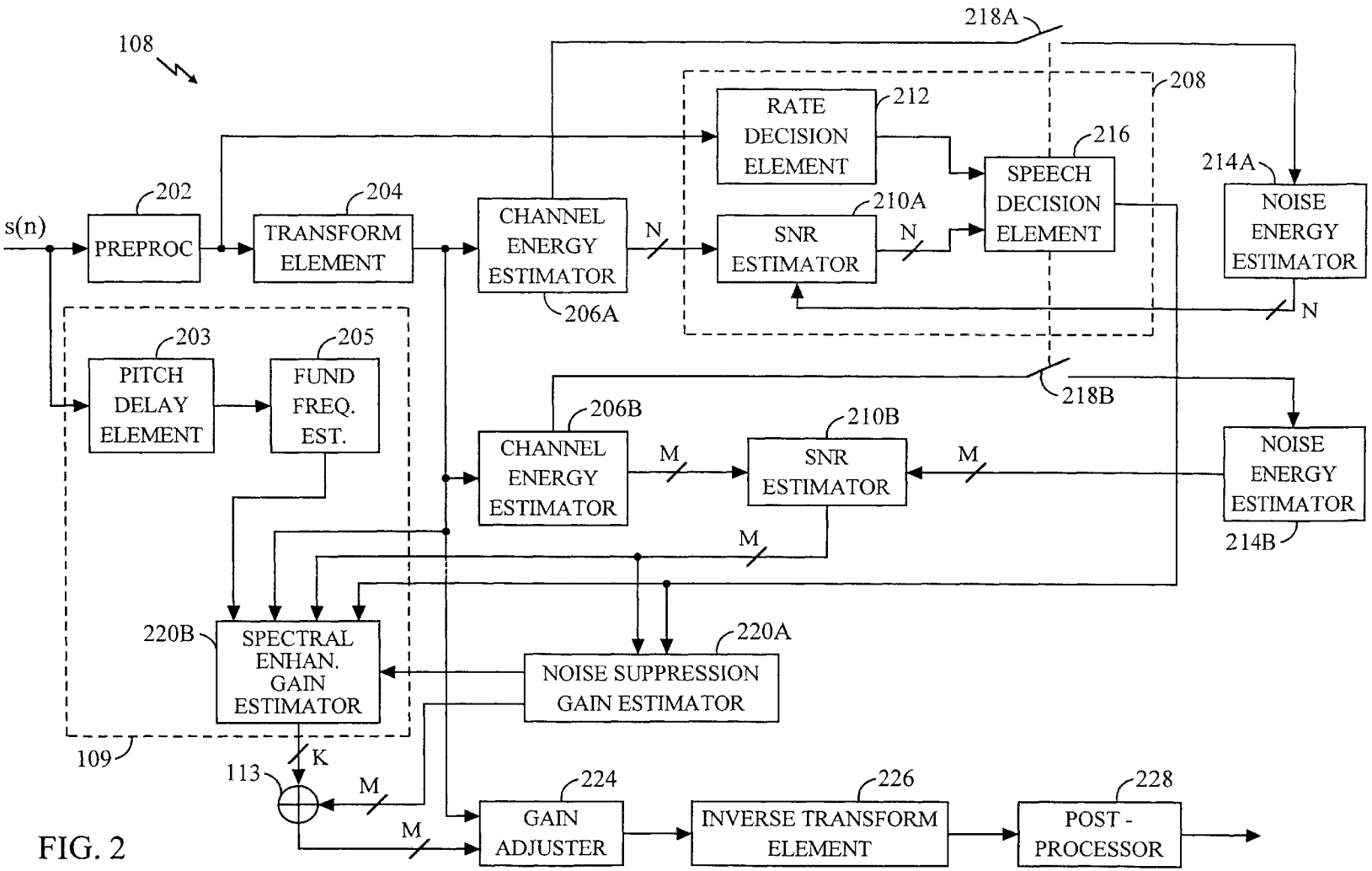
FIG. 2 is a block diagram of the spectral enhancer of the present invention in connection with a noise suppressor section of a speech processor of a communication system.

An exemplary embodiment of the spectral enhancer 109 of the present invention used in connection with the noise suppressor 108 is illustrated in FIG. 2. In the embodiment of FIG. 2, the low frequency enhancer function is performed concurrently with the noise suppression function. Those skilled in the art will appreciate that the teachings of the present invention may be utilized with systems other than the noise suppressor of the illustrative embodiment without departing from the scope of the present invention.

As shown in FIG. 2, the input audio signal s(n) is received by a preprocessor 202. The preprocessor 202 prepares the input signal for noise suppression and enhancement by performing pre-emphasis and frame generation. Pre-emphasis redistributes the power spectral density of the speech signal by emphasizing the high frequency speech components of the signal. Essentially performing a high pass filtering function, pre-emphasis emphasizes the important speech components to enhance the SNR of these components in the frequency domain. The preprocessor 202 may also generate frames from the samples of the input signal. In a preferred embodiment, 10 ms frames of 80 samples/frame are generated. The frames may have overlapped samples for better processing accuracy. The frames may be generated by windowing and zero padding of the samples of the input signal.

The preprocessed signal is presented to a transform element 204. In a preferred embodiment, the transform element 204 generates a 128 point Fast Fourier Transform (FFT) for each frame of input signal. It should be understood, however, that alternative schemes may be used to analyze the frequency components of the input signal.

The transformed components are provided to a channel energy estimator 206*a*, which generates an energy estimate for each of N channels of the transformed signal. For each channel, one technique for updating the channel energy estimates smoothes the current channel energy over the channel energies of the previous frames as follows:

$$E_u(t)=aE_{ch}+(1-a)E_u(t-1), \tag{1}$$

where the updated estimate, $E_u(t)$, is defined as a function of the current channel energy, $E_{ch}$, and the previous estimated channel energy, $E_u,(t-1)$. An exemplary embodiment sets a=0.55.

A preferred embodiment determines an energy estimate for a low frequency channel and an energy estimate for a high frequency channel, so that N=2. The low frequency channel corresponds to frequency range from 250 to 2250 Hz, while the high frequency channel corresponds to frequency range from 2250 to 3500 Hz. The current channel energy of the low frequency channel may be determined by summing the energy of the FFT points corresponding to 250–2250 Hz, and the current channel energy of the high frequency channel may be determined by summing the energy of the FFT points corresponding to 2250–3500 Hz.

The energy estimates are provided to a speech detector 208, which determines whether or not speech is present in the received audio signal. A SNR estimator 210*a* of the speech detector 208 receives the energy estimates. The SNR estimator 210*a* determines the signal-to-noise ratio (SNR) of the speech in each of the N channels based on the channel energy estimates and the channel noise energy estimates. The channel noise energy estimates are provided by the noise energy estimator 214*a* and generally correspond to the estimated noise energy smoothed over the previous frames which do not contain speech.

The speech detector 208 also comprises a rate decision element 212, which selects the data rate of the input signal from a predetermined set of data rates. In certain communication systems, data is encoded so that the data rate may be varied from one frame to another. This is known as a variable rate communication system. The voice coder which encodes data based on a variable rate scheme is typically called a variable rate vocoder. An exemplary embodiment of a variable rate vocoder is described in U.S. Pat. No. 5,414,796, entitled "VARIABLE RATE VOCODER," assigned to the assignee of the present invention and incorporated herein by reference. The use of a variable rate communications channel eliminates unnecessary transmissions when there is no useful speech to be transmitted. Algorithms are utilized within the vocoder for generating a varying number of information bits in each frame in accordance with variations in speech activity. For example, a vocoder with a set of four rates may produce 20 millisecond data frames containing 16, 40, 80, or 171 information bits, depending on the activity of the speaker. It is desired to transmit each data frame in a fixed amount of time by varying the transmission rate of communications.

Because the rate of a frame is dependent on the speech activity during a time frame, determining the rate will provide information on whether speech is present or not. In a system utilizing variable rates, a determination that a frame should be encoded at the highest rate generally indicates the presence of speech, while a determination that a frame should be encoded at the lowest rate generally indicates the absence of speech. Intermediate rates typically indicate transitions between the presence and the absence of speech.

The rate decision element 212 may implement any of a number of rate decision algorithms. One such rate decision algorithm is disclosed in U.S. Pat. No. 5,911,128, entitled "METHOD AND APPARATUS FOR PERFORMING SPEECH FRAME ENCODING MODE SELECTION IN A VARIABLE RATE ENCODING SYSTEM," issued on Jun. 8, 1999, and assigned to the assignee of the present invention and incorporated by reference herein. This technique provides a set of rate decision criteria referred to as mode measures. A first mode measure is the target matching signal to noise ratio (TMSNR) from the previous encoding frame, which provides information on how well the encoding model is performing by comparing a synthesized speech signal with the input speech signal. A second mode measure is the normalized autocorrelation function (NACF), which measures periodicity in the speech frame. A third mode measure is the zero crossings (ZC) parameter, which measures high frequency content in an input speech frame. A fourth measure, the prediction gain differential (PGD), determines if the encoder is maintaining its prediction efficiency. A fifth measure is the energy differential (ED), which compares the energy in the current frame to an average frame energy. Using these mode measures, a rate determination logic selects an encoding rate for the frame of input.

It should be understood that although the rate decision element 212 is shown in FIG. 2 as an included element of the noise suppressor 108, the rate information may instead be provided to the noise suppressor 108 by another component of the speech processor 106 (FIG. 1). For example, the speech processor 106 may comprise a variable rate vocoder (not shown) which determines the encoding rate for each frame of input signal. Instead of having the noise suppressor 108 independently perform rate determination, the rate information may be provided to the noise suppressor 108 by the variable rate vocoder.

It should also be understood that instead of using the rate decision to determine the presence of speech, the speech detector 208 may use a subset of the mode measures that contribute to the rate decision. For instance, the rate decision element 212 may be substituted by a NACF element (not shown), which, as explained earlier, measures periodicity in the speech frame. The NACF is evaluated in accordance with the relationship below:

$$NACF = \frac{\max\limits_{T \in [t_1, t_2]} \left\{ \sum_{n=0}^{N-1} e(n) \cdot e(n-T) \right\}}{0.5 \cdot \sum_{n=0}^{N-1} \{e^2(n) + e^2(n-T)\}} \tag{2}$$

where N refers to the numbers of samples of the speech frame, $t_1$ and $t_2$ refer to the boundaries within the T samples for which the NACF is evaluated. The NACF is evaluated based on the formant residual signal, e(n). Formant frequencies are the resonance frequencies of speech. A short-term filter is used to filter the speech signal to obtain the formant frequencies. The residual signal obtained after filtering by the short-term filter is the formant residual signal and contains the long-term speech information, such as the pitch, of the signal. The formant residual signal may be derived as explained later in this description.

The NACF mode measure is suitable for determining the presence of speech because the periodicity of a signal containing voiced speech is different from a signal which does not contain voiced speech. The periodicity of the signal is directly related to the pitch of the signal. A voiced speech signal tends to be characterized by periodic components. When voiced speech is not present, the signal generally will not have periodic components. Thus, the NACF measure is a good indicator which may be used by the speech detector 208.

The speech detector 208 may use measures such as the NACF instead of the rate decision in situations where it is not practical to generate the rate decision. For example, if the rate decision is not available from the variable rate vocoder, and the noise processor 108 does not have the processing power to generate its own rate decision, then mode measures like the NACF offer a desirable alternative. This may be the case in a carkit application where processing power is generally limited.

Additionally, it should be understood that the speech detector 208 may make a determination regarding the presence of speech based on the rate decision, the mode measure (s), or the SNR estimate alone. Although additional measures should improve the accuracy of the determination, any one of the measures alone may provide an adequate result.

The rate decision (or the mode measure(s)) and the SNR estimate generated by the SNR estimator 210*a* are provided to a speech decision element 216. The speech decision element 216 generates a decision on whether or not speech is present in the input signal based on its inputs. The decision on the presence of speech will determine if a noise energy estimate update should be performed. The noise energy estimate is used by the SNR estimator 210*a* to determine the SNR of the speech in the input signal. The SNR will in turn be used to compute the level of attenuation of the input signal for noise suppression. If it is determined that speech is present, then speech decision element 216 opens a switch 218*a*, preventing the noise energy estimator 214*a* from updating the noise energy estimate. If it is determined that speech is not present, then the input signal is assumed to be noise, and the speech decision element 216 closes the switch 218*a*, causing the noise energy estimator 214*a* to update the noise estimate.

Although shown in FIG. 2 as a switch 218*a*, it should be understood that an enable signal provided by the speech decision element 216 to the noise energy estimator 214*a* may perform the same function.

In a preferred embodiment in which two channel SNRs are evaluated, the speech decision element 216 generates the noise update decision based on the procedure below:

```
if (rate=min)
  if ((chsnr1>T1) OR (chsnr2>T2))
    if (ratecount>T3)
      update noise estimate
    else
      ratecount++
  else
    update noise estimate
    ratecount=0
else
  ratecount=0
```

The channel SNR estimates provided by the SNR estimator 210*a* are denoted by chsnr1 and chsnr2. The rate of the input signal, provided by the rate decision element 212, is denoted by 'rate'. A counter (ratecount) keeps track of the number of frames based on certain conditions as described below.

If the rate is the minimum rate of the variable rates, either chsnr1 is greater than threshold T1 or chsnr2 is greater than threshold T2, and ratecount is greater than threshold T3, then a noise estimate update is performed. If the rate is minimum, and either chsnr1 is greater than T1 or chsnr2 is greater than T2, but ratecount is less than T3, then the ratecount is increased by one but no noise estimate update is performed. The counter, ratecount, detects the case of a sudden increased level of noise or an increasing noise source by counting the number of frames having minimum rate but also having high energy in at least one of the channels. The counter, which provides an indicator that the high SNR signal contains no speech, is set to count until speech is detected in the signal. A preferred embodiment sets T1=T2=5 dB, and T3=100 frames where 10 ms frames are evaluated.

If the rate is minimum, chsnr1 is less than T1, and chsnr2 is less than T2, then speech decision element 216 will determine that speech is not present and that a noise estimate update should be performed. In addition, ratecount is reset to zero.

If the rate is not minimum, then the speech decision element 216 will determine that the frame contains speech, and no noise estimate update is performed. In addition, ratecount is reset to zero.

Instead of using the rate measure to determine the presence of speech, recall that mode measures such as a NACF measure may be utilized instead. The speech decision element 216 may make use of the NACF measure to determine the presence of speech, and thus the noise update decision, in accordance with the procedure below:

```
if (pitchPresent=FALSE)
  if ((chsnr1>TH1) OR (chsnr2>TH2))
    if (pitchCount>TH3)
      update noise estimate
    else
      pitchCount++
  else
    update noise estimate
    pitchCount=0
else
  pitchCount=0
```

where pitchPresent is defined as follows:

```
if (NACF>TT1)
  pitchPresent=TRUE
  NACFcount=0
else if (TT2≦NACF≦TT1)
  if (NACFcount>TT3)
    pitchPresent=TRUE
  else
    pitchPresent=FALSE
    NACFcount++
else
  pitchPresent=FALSE
  NACFcount=0
```

Again, channel SNR estimates provided by the SNR estimator 210*a* are denoted by chsnr1 and chsnr2. A NACF element (not shown) generates a measure indicative of the presence of pitch, pitchPresent, as defined above. A counter, pitchCount, keeps track of the number of frames based on certain conditions as described below.

The measure pitchPresent determines that pitch is present if NACF is above threshold TT1. If NACF falls within a mid range (TT2≦NACF≦TT1) for a number of frames greater than threshold TT3, then pitch is also determined to be present. A counter, NACFcount, keeps track of the number of frames for which TT2≦NACF≦TT1. In a preferred embodiment, TT1=0.6, TT2=0.4, and TT3=8 frames where 10 ms frames are evaluated.

The speech decision element 216 determines that speech is not present, and that the noise estimate should be updated, if the pitchPresent measure indicates that pitch is not present (pitchPresent=FALSE), either chsnr1 is greater than threshold TH1 or chsnr2 is greater than threshold TH2, and pitchCount is greater than threshold TH3. If pitchPresent=FALSE, and either chsnr1 is greater than TH1 or chsnr2 is greater than TH2, but pitchCount is less than TH3, then pitchCount is increased by one but no noise estimate update is performed. The counter, pitchCount, is used to detect the case of a sudden increased level of noise or an increasing noise source. A preferred embodiment sets TH1=TH2=5 dB, and TH2=100 frames where 10 ms frames are evaluated.

If pitchPresent indicates that pitch is not present, and chsnr1 is less than TH1 and chsnr2 is less than TH2, then the speech decision element 216 will determine that speech is not present and that a noise estimate update should be performed. In addition, pitchCount is reset to zero.

If pitchPresent indicates that pitch is present (pitchPresent=TRUE), then the speech decision element 216 will determine that the frame contains speech, and no noise estimate update is performed. In addition, pitchCount is reset to zero.

Upon determination that speech is not present, the switch 218*a* is closed, causing the noise energy estimator 214*a* to update the noise estimate. The noise energy estimator 214*a* generally generates a noise energy estimate for each of the N channels of the input signal. Since speech is not present, the energy is presumed to be wholly contributed by noise. For each channel, the noise energy update is estimated to be the current channel energy smoothed over channel energies of previous frames which do not contain speech. For example, the updated estimate may be obtained based on the relationship below:

$$E_n(t)=bE_{ch}+(1-b)E_n(t-1), \quad (3)$$

where the updated estimate, $E_n(t)$, is defined as a function of the current channel energy, $E_{ch}$, and the previous estimated channel noise energy, $E_n(t-1)$. An exemplary embodiment sets b=0.1. The updated channel noise energy estimates are presented to the SNR estimator 210*a*. These channel noise energy estimates will be used to obtain channel SNR estimate updates for the next frame of input signal.

The determination regarding the presence of speech is also provided to a noise suppression gain estimator 220*a*. The noise suppression gain estimator 220*a* determines the gain, and thus the level of noise suppression, for the frame of input signal. If the speech decision element 216 has determined that speech is not present, then the gain for the frame is set at a predetermined minimum gain level. Otherwise, the gain is determined as a function of frequency.

If speech is determined to be present, then for each frame containing speech, a gain factor is determined for each of M frequency channels of the input signal, where M is the predetermined number of channels to be evaluated. A preferred embodiment evaluates sixteen channels (M=16).

For each channel evaluated, the channel SNR is used to derive the gain factor based on an appropriate curve. This is disclosed more fully in U.S. Pat. No. 6,122,384, entitled "NOISE SUPPRESSION SYSTEM AND METHOD," issued Sep. 19, 2000, and assigned to the present assignee and incorporated herein by reference.

The channel SNRs are shown, in FIG. 2, to be evaluated by the SNR estimator 210*b* based on input from the channel energy estimator 206*b* and the noise energy estimator 214*b*. For each frame of input signal, the channel energy estimator 206*b* generates energy estimates for each of M channels of the transformed input signal, and provides the energy estimates to the SNR estimator 210*b*. The channel energy estimates may be updated using the relationship of Equation (1) above. If it is determined by speech decision element 216 that no speech is present in the input signal, then the switch 218*b* is closed, and the noise energy estimator 214*b* updates the estimates of the channel noise energy. For each of the M channels, the updated noise energy estimate is based on the channel energy estimate determined by the channel energy estimator 206*b*. The updated noise estimate may be evaluated using the relationship of Equation (3) above. The channel noise estimates are provided to the SNR estimator 210*b*. Thus, the SNR estimator 210*b* determines channel SNR estimates for each frame of speech based on the channel energy estimates for the particular frame of speech and the channel noise energy estimates provided by the noise energy estimator 214*b*.

An artisan skilled in the art would recognize that the channel energy estimator 206*a*, the noise energy estimator 214*a*, the switch 218*a*, and the SNR estimator 210*a* perform functions similar to the channel energy estimator 206*b*, the noise energy estimator 214*b*, the switch 218*b*, and the SNR estimator 210*b*, respectively. Thus, although shown as separate processing elements in FIG. 2, the channel energy estimators 206*a* and 206*b* may be combined as one processing element, the noise energy estimators 214*a* and 214*b* may be combined as one processing element, the switches 218*a* and 218*b* may be combined as one processing element, and the SNR estimators 210*a* and 210*b* may be combined as one processing element. As combined elements, the channel energy estimator would determine channel energy estimates for both the N channels used for speech detection and the M channels used for determining channel gain factors. Note that it is possible for N=M. Likewise, the noise energy estimator and the SNR estimator would operate on both the N channels and the M channels. The SNR estimator then provides the N SNR estimates to the speech decision element 216, and provides the M SNR estimates to the noise suppression gain estimator 220*a*.

In accordance with the present teachings and as mentioned above, the spectral enhancer 109 is provided as part of the speech processor 106 of FIG. 1. As shown in FIG. 2, the spectral enhancer 109 includes a pitch delay element 203, a speech fundamental frequency estimator 205, and a spectral enhancement gain estimator 220*b*. As discussed more fully below, the speech fundamental frequency estimator 205 divides the speech sampling rate by the pitch delay and thereby ascertains a fundamental frequency of the speech.

The spectral enhancement gain estimator 220*b* receives a transformed signal from transform element 204. The spectral enhancement gain estimator 220*b* then determines the enhancement to be applied to certain frequency channels, or bins, of the transformed signal. Enhancement is determined based on the speech fundamental frequency provided by the fundamental frequency estimator 205, noise suppression gain estimates provided by the noise suppression gain estimator 220*a*, and a speech present signal provided by the speech decision element 216. The procedure for determining the spectral enhancement gain necessary to compensate for attenuated low frequency components in the output speech signal is described more fully below. Note that because the noise suppression gain estimates are dependent on the SNR estimates provided by SNR estimator 210*b*, the spectral enhancement gain estimator 220*b* may use the SNR estimates from the SNR estimator 210*b* instead of the noise suppression gain estimates from the noise suppression gain estimator 220*a* to determine the spectral enhancement gain estimates.

The spectral enhancer 109 provides adjusted gain estimates which are summed with the gain estimates provided by the noise suppression gain estimator 220*a* at summer 113. As shown in FIG. 2, K gain estimates are provided by the spectral enhancement gain estimator 220*b* while M gain estimates are provided by the noise suppression gain estimator 220*a*. This is because the spectral enhancer 109 will typically select only a range of frequencies for which the signal is to be enhanced. Thus, in general, K<M. One having ordinary skill in the art will recognize that summer 113 sums only the gain values for the corresponding frequency channels.

The summed gain estimates are input to a gain adjuster 224. Gain adjuster 224 also receives the FFT transformed input signal from transform element 204. The gain of the transformed signal is appropriately adjusted according to the gain estimates provided by estimators 220*a* and 220*b*. For example, in the embodiment described above wherein M=16, the transformed (FFT) points belonging to the particular one of the sixteen channels are adjusted based on the appropriate gain estimate.

The gain adjusted signal generated by gain adjuster 224 is then provided to inverse transform element 226, which in a preferred embodiment generates the Inverse Fast Fourier Transform (IFFT) of the signal. The inverse transformed signal is provided to post processing element 228. If the frames of input had been formed with overlapped samples, then post processing element 228 adjusts the output signal for the overlap. Post processing element 228 also performs deemphasis if the signal had undergone preemphasis. Deemphasis attenuates the frequency components that were emphasized during preemphasis. The preemphasis/deemphasis process effectively contributes to noise suppression by reducing the noise components lying outside of the range of the processed frequency components.

Figure 3:
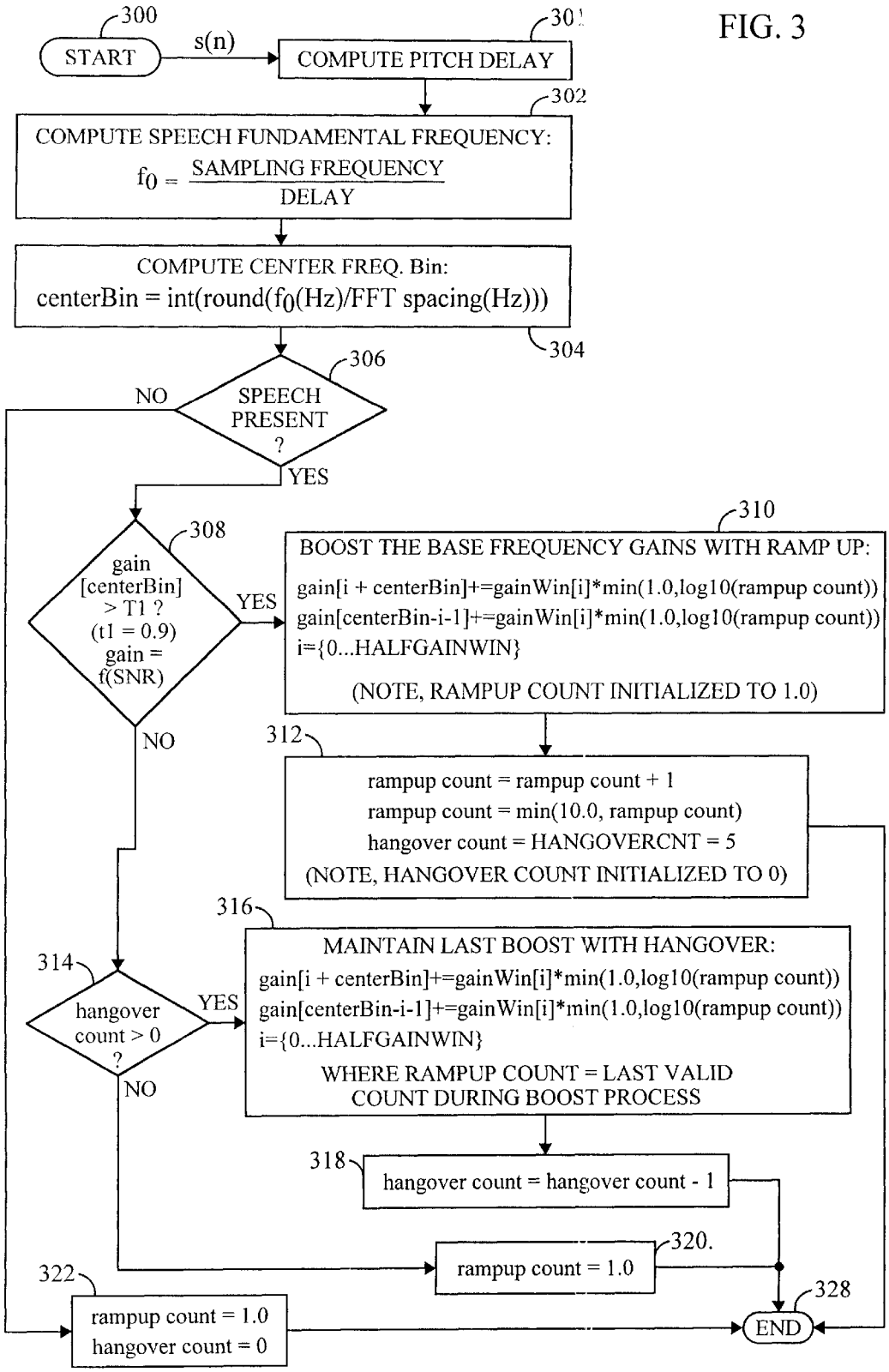
FIG. 3 is a flow chart of an illustrative implementation of the spectral enhancement system and method of the present invention.

The method of the present invention implemented by the spectral enhancer 109 is illustrated by the flow chart 300 of FIG. 3. In a first step 301, pitch delay is computed. The pitch delay is a measure of the periodicity of the speech. As is known in the art, the vocoder implementation of the speech processor 106 has an associated speech metric expressed in terms of a delay over a window of speech. This delay is the pitch delay (also known as the pitch lag) and represents a spacing in the peaks of the autocorrelation of the prediction residual.

Many techniques may be used to determine pitch delay. Therefore, the present invention is not limited to the manner by which the pitch delay of the speech is computed.

The pitch delay may be determined from the formant residual signal, e(n). As discussed above, the formant residual signal contains the long-term information, such as the pitch, of a speech signal.

One technique for generating the formant residual signal makes use of linear predictive coding (LPC) analysis. LPC analysis is used to compute the coefficients of a linear predictive filter, which predicts the short term components of the speech signal. Using LPC analysis, the speech segment to be analyzed is generally windowed, as by a hamming window. From the windowed signal w(n), the autocorrelation signal is then determined as follows:

$$R(n) = \sum_{k=0}^{N-n} w(k) \cdot w(k+n), \tag{4}$$

where N refers to the numbers of samples of the speech frame.

The LPC coefficients, $a_i$, are then computed using the autocorrelation signal using Durbin's recursion as discussed in the text *Digital Processing of Speech Signals* by Rabiner & Schafer. Durbin's recursion is a known efficient computational method. The algorithm can be stated as follows:

(a) $E^{(0)} = R(0),\ i = 1$ (b) $k_i = \dfrac{\left\{R(i) - \sum_{j=1}^{i-1} \alpha_j^{(i-1)} R(i-j)\right\}}{E^{(i-1)}}$ (c) $\alpha_i^{(i)} = k_i$ (d) $\alpha_j^{(i)} = \alpha_j^{(i-1)} - k_i \alpha_{ij}^{(i-1)} \quad 1 <= j <= i-1$ (e) $E^{(i)} = (1 - k_i^2) E^{(i-1)}$ (f) If $i < P$, then go to (*b*) with $i = i + 1$.

(g) The final solution for the LPC coefficients is given as: $a_j = \alpha_j^{(P)}$ where $1 \leqq j \leqq P$.

After the LPC coefficients are computed, the formant residual e(n) is derived by filtering the speech signal s(n) by the prediction error filter A(z), defined by:

$$A(z) = 1 - \sum_{i=1}^{P} a_1 z^{-i}. \tag{5}$$

If the prediction error filter A(z) is working properly, the output e(n) will appear as white noise because the prediction filter has effectively removed the short term redundancies (harmonics) in the speech. The long term redundancies (pitch) remain and are not 'predicted out' by the filter. As a result, these effects appear as large error components (peaks) at the output. The periodicity of these peaks are used for the computation of pitch delay and are inversely proportional to the fundamental frequency of the speech (i.e. low frequency speech has a large spacing between the peaks, high frequency speech has a small spacing between peaks). The method for generation of open loop pitch delay autocorrelation R(n) is as follows:

$$R(n) = \text{sum}(e(k) * e(k+n)) \tag{6}$$

where k=0 . . 160−n, and n=20 . . 120 is the range where the pitch delay is expected to be found.

The pitch delay is the value of 'n' that is found that maximizes R(n). As an alternative, the pitch delay may be determined from the NACF. In this case, the pitch delay is the n value that maximizes the NACF. (See equation (2) above.

Returning to FIG. 3, at step 302, the inventive spectral enhancer 109 uses pitch delay information supplied by the speech processor 106 to compute the fundamental frequency of the speech. In the illustrative embodiment, the fundamental frequency of the speech is obtained as follows:

$$f_o = f_s / pd \tag{7}$$

where $f_o$ is the speech fundamental frequency, $f_s$ is the sampling frequency, and pd is the pitch delay.

Still referring to FIG. 3, at step 304, the fundamental frequency computed by equation (9) is mapped to a center frequency bin as follows:

$$\text{centerBin} = \text{int}(\text{round}(f_o(\text{Hz})/FFT\ \text{spacing}(\text{Hz}))). \tag{8}$$

The center frequency bin is the frequency bin in which the fundamental frequency is located. After the center frequency bin is determined, a gain window is positioned around the center frequency bin. The gain window defines the range of frequencies that are enhanced by the spectral enhancer 109. The use of a gain window around the center bin ensures that part of the fundamental frequency that may have fallen into an adjacent bin is not lost to subsequent processing steps causing a distortion of the speech output.

The gain to be applied in each frequency bin within the gain window is then determined as further shown in FIG. 3. At step 306, the spectral enhancer 109 checks to determine whether speech is present in the input signal. The determination whether speech is present is provided by the speech decision element 216 of FIG. 2.

If speech is present, then at step 308, the enhancer 109 checks the signal-to-noise ratio of the signal within the center bin. As disclosed above, the noise suppressor applies gain based on the signal-to-noise ratio of the signal. Hence, the signal-to-noise ratio of the signal in the center bin may be inferred from the gain provided by the noise suppression gain estimator 220*a*. Accordingly, at step 308, the noise suppression gain in the center bin is compared to a first threshold (T1). In the illustrative embodiment, the first threshold T1 is 0.9. Hence, if the noise suppression gain is 1, the signal in the center bin has not been attenuated providing an indication that the signal-to-noise ratio of the signal is such as to suggest that the signal represents speech as opposed to noise.

If the noise suppression gain in the center bin is greater than Ti, then at step 310, the enhancer 109 boosts the base frequency gains gradually, that is, with ramp up. The expres sion for the operation performed in step 310 is provided below:

$$gain[i+centerBin]+=gainWin[i]*min(1.0,log10(rampup\ count)) \quad (9)$$

$$gain[centerBin-i-1]+=gainWin[i]*min(1.0,log10(rampup\ count)) \quad (10)$$

where i={0 . . . HALFGAINWIN}, gainWin[i] is the points of a Hamming window (in the illustrative embodiment, a 9-point Hamming window is used), and rampup count is a parameter which regulates the amount of gain applied by the spectral enhancer. The rampup count has been initialized to 1.0.

In step 312, rampup count is incremented and compared to a threshold of 10 and a hangover count is set. The use of the rampup count allows for a gradual increase in gain over successive frames for stable operation in cases where the signal-to-noise ratio is close to the threshold. Likewise, the use of a hangover count prohibits the enhancement function from turning on and off over successive frames in which the signal to noise ratio is close to the threshold.

Returning to step 308, if the gain or signal-to-noise of the center bin is less than T1, then at steps 314 and 316, the enhancer 109 maintains the current gain value for a predetermined number of frames based on the preset hangover count. The following describes the operation performed at step 316:

$$gain[i+centerBin]+=gainWin[i]*min(1.0,log10(rampup\ count)) \quad (11)$$

$$gain[centerBin-i-1]+=gainWin[i]*min(1.0,log10(rampup\ count)) \quad (12)$$

where all variables are defined above with respect to equations (11) and (12) with the exception that the rampup count is equal to the last valid count during the boost process (steps 310 and 312). At step 318, the hangover count is decremented.

Returning to step 314, if the hangover count is zero the rampup count is initialized to 1.0.

If speech is not present at step 306, the system makes a noise estimate update. If the system is making a noise estimate update, at step 322 it resets the rampup count and the hangover count.

On the completion of steps 312, 318, 320, or 322, the spectral enhancer 109 returns a set of gain values for each of the frequency bins within the gain window. The gain values are then applied so as to enhance the low frequency spectral components as needed.

Figure 4A:
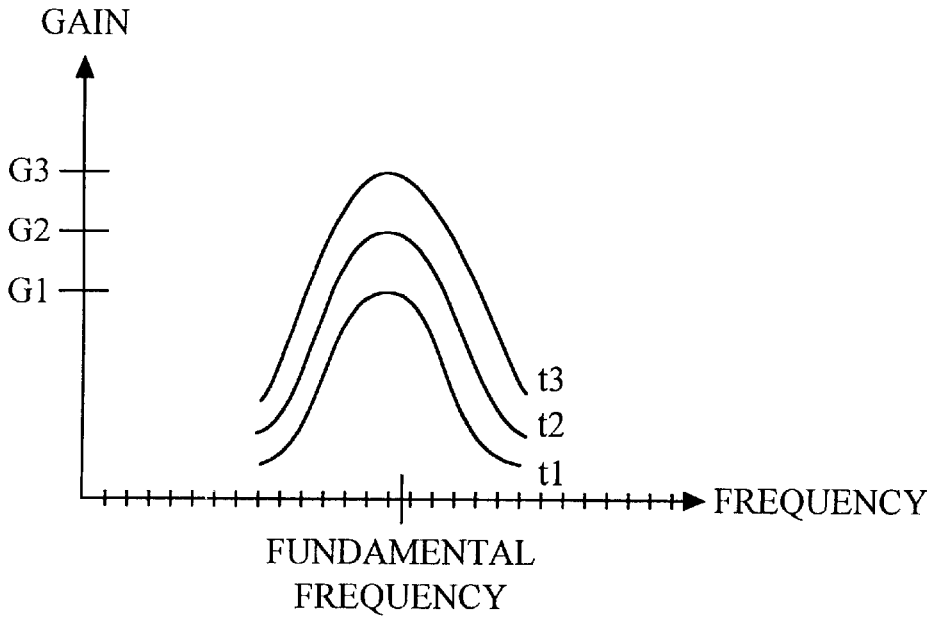
FIG. 4*a* is a graph illustrating an example of the spectral enhancement gain to be applied to a series of frames of speech in accordance with the present invention.
Figure 4B:
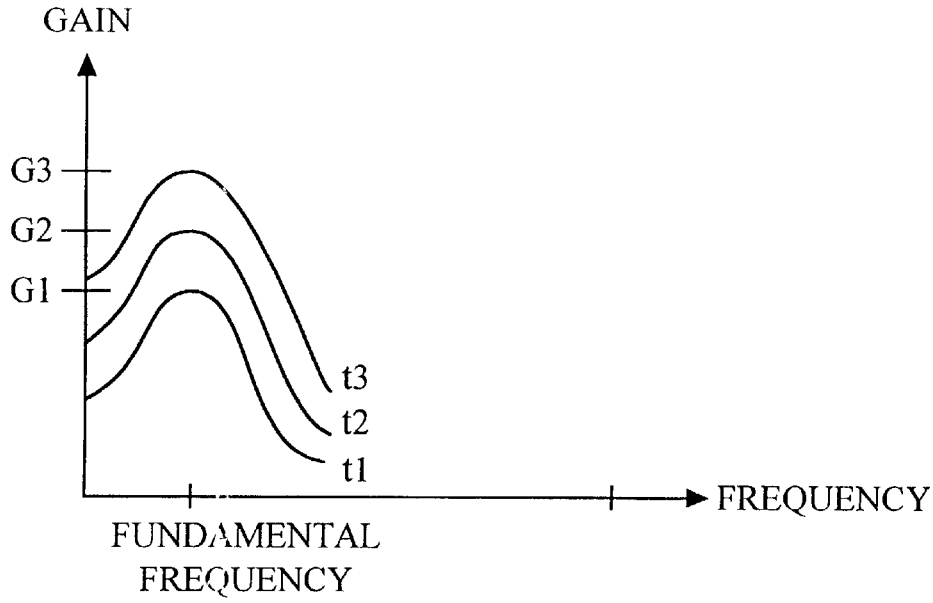
FIG. 4*b* is a graph illustrating another example of the spectral enhancement gain to be applied to a series of frames of speech in accordance with the present invention.

Referring now to FIG. 4*a*, a graph illustrating the spectral enhancement gain that may be applied to successive frames of speech is shown. In FIG. 4*a*, the center bin is the frequency bin in which the fundamental frequency is found. At time t1, a spectral enhancement gain of G1 is applied to the frequency components of the center bin, while a Hamming window is used to define a range of frequencies within a predetermined range of the center bin for which gain is also applied. As time progresses (t2, t3, . . .), the gain window is ramped up and although not shown in FIG. 4*a*, hanged over to smooth the amplification function between successive frames. Note that in FIG. 4*a*, the entire gain window is located in frequencies greater than zero. If the fundamental frequency is low, the gain window may not be entirely located in frequencies greater than zero. In this case, only those frequencies greater than zero are enhanced by the spectral enhancer, as shown in FIG. 4*b*.

Thus, the present invention has been described herein with reference to a particular embodiment for a particular application. Those having ordinary skill in the art and access to the present teachings will recognize additional modifications, applications, and embodiments within the scope thereof. For example, it should be understood that the various processing blocks of the system shown in FIGS. 2 and 3 may be configured in a digital signal processor (DSP) or an application specific integrated circuit (ASIC). The description of the functionality of the present invention would enable one of ordinary skill to implement the present invention in a DSP or an ASIC without undue experimentation.

It is therefore intended by the appended claims to cover any and all such applications, modifications, and embodiments within the scope of the present invention.

Accordingly,

We claim:

1. A system for enhancing low frequency spectral content of a signal transmitted via a channel, the system comprising:

noise suppression circuit operative to update channel energy estimates; and spectral enhancer circuit coupled to and precedes the noise suppression circuit, the spectral enhancer circuit operative to determine channel enhancement in response to the channel energy estimates.

2. The system of claim 1 wherein a channel energy estimate update is a function of a current channel energy and at least one previous channel energy.

3. The system of claim 2, wherein the noise suppression circuit comprises: a transform element operative to perform a Fast Fourier Transform (EFT) for each frame of the signal, wherein channel energy is a summation of energies of FFT points.

4. The system of claim 1, further comprising: a speech detector operative to detect speech content of the signal.

5. The system of claim 4, wherein the speech detector further comprises: a rate decision element coupled to the noise suppression circuit and the spectral enhancer circuit, the rate decision element operative to select a data rate for the signal.

6. The system of claim 5, wherein the spectral enhancer circuit is further responsive to the speech detector in determining the channel enhancement.

* * * * *